US007070311B2

(12) United States Patent
Lee

(10) Patent No.: US 7,070,311 B2
(45) Date of Patent: Jul. 4, 2006

(54) VEHICLE LIGHT FOR PRODUCING LIGHT WHOSE FORM DEPENDS ON ORIENTATIONS OF PLURAL REFRACTION ELEMENTS

(75) Inventor: Jihn-Shiun Lee, Tainan (TW)

(73) Assignee: Fu An Industrial Co., Ltd., Tainan (TW)

( * ) Notice: Subject to any disclaimer, the term of this patent is extended or adjusted under 35 U.S.C. 154(b) by 90 days.

(21) Appl. No.: 10/859,105

(22) Filed: Jun. 3, 2004

(65) Prior Publication Data

US 2005/0270791 A1 Dec. 8, 2005

(51) Int. Cl.
*F21S 8/10* (2006.01)

(52) U.S. Cl. ..... 362/545; 362/240; 362/241; 362/329; 362/800

(58) Field of Classification Search ..... 362/240, 362/41, 45, 329, 336–8, 545, 800
See application file for complete search history.

(56) References Cited

U.S. PATENT DOCUMENTS 5,383,102 A * 1/1995 Jones ..... 362/510
5,490,049 A * 2/1996 Montalan et al. ..... 362/240
5,676,453 A * 10/1997 Parkyn et al. ..... 362/260
5,848,839 A * 12/1998 Savage, Jr. ..... 362/267
6,019,492 A * 2/2000 Ikegaya et al. ..... 362/521
6,398,988 B1 * 6/2002 Jenkins et al. ..... 264/2.2
6,469,622 B1 * 10/2002 Komatsu et al. ..... 340/464
6,520,666 B1 * 2/2003 Beyerlein et al. ..... 362/471
6,948,838 B1 * 9/2005 Kunstler ..... 362/545

* cited by examiner

*Primary Examiner*—Thomas M. Sember
*Assistant Examiner*—Adam C. Rehm
(74) *Attorney, Agent, or Firm*—Rosenberg, Klein & Lee

(57) ABSTRACT

A vehicle light includes several light source units positioned on different planes, each of which light source units has a light emitting diode, and a transparent convex covering part formed with a refraction side facing the light emitting diode; when light from one of the light emitting diodes travel through the corresponding convex covering part, the corresponding refraction side can make it change direction; therefore, when the light source units are positioned such that the refraction elements are in various orientations, light from the present vehicle light can he diverted into different directions by means of the refraction elements. In other words, when being activated, the vehicle light will produce light whose form depends on orientations of the refraction elements of the light source units.

1 Claim, 6 Drawing Sheets

VEHICLE LIGHT FOR PRODUCING LIGHT WHOSE FORM DEPENDS ON ORIENTATIONS OF PLURAL REFRACTION ELEMENTS

BACKGROUND OF THE INVENTION

1. Field of the Invention

The present invention relates to a vehicle light, more particularly one, which includes several light source units each having a light emitting diode, and a refraction side facing the light emitting diode such that it can produce light whose form depends on orientations of the refraction elements of the light source units.

2. Brief Description of the Prior Art

Bulbs and LED are common light sources for vehicle lights. Referring to FIGS. 14 and 15, a conventional vehicle light (B) includes an outer shell 41, a reflecting shell 42 secured in the outer shell 41, a transparent cover 43 secured on an opening of the outer shell 41, and a bulb set 40 securely disposed in the reflecting shell 42; the bulb set 40 include those capable of producing far-reaching light, and ordinary bulbs for suiting different situations. When bulbs of the bulb set 40 are powered, light from the bulbs will be reflected by means of the reflecting shell 42, traveling in a certain direction and spreading out over a certain area.

No matter which kinds of bulbs are powered, the area that will be covered by light from this vehicle light is fixed. Therefore, vehicle lights of such structure can only produce a fixed form of light, i.e. light that spreads out over the same area. Consequently, light, which spreads out over a particular area for suiting special needs, can't be produced with vehicle lights of such structure.

SUMMARY

It is a main object of the present invention to provide a vehicle light to overcome the above disadvantages.

The vehicle light of the present invention includes several light source units positioned on different planes, each of which light source units has a light emitting diode, and a transparent convex covering part formed with a refraction side facing the light emitting diode. When light from one of the light emitting diodes travel through the corresponding convex covering part, the corresponding refraction side can make it change direction. Therefore, when the light source units are positioned such that the refraction elements of the transparent convex covering parts are in various orientations, light from the present vehicle light can be diverted into different directions by means of the refraction elements. In other words, when being activated, the vehicle light will produce light whose form depends on orientations of the refraction elements of the light source units.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 2:
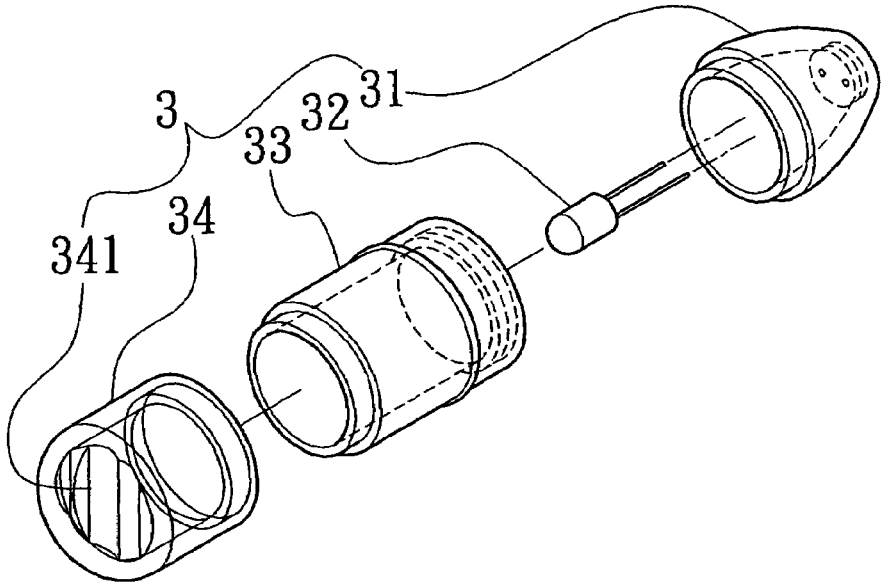
FIG. 2 is an exploded perspective view of the third embodiment of light source unit in the present invention.
Figure 3:
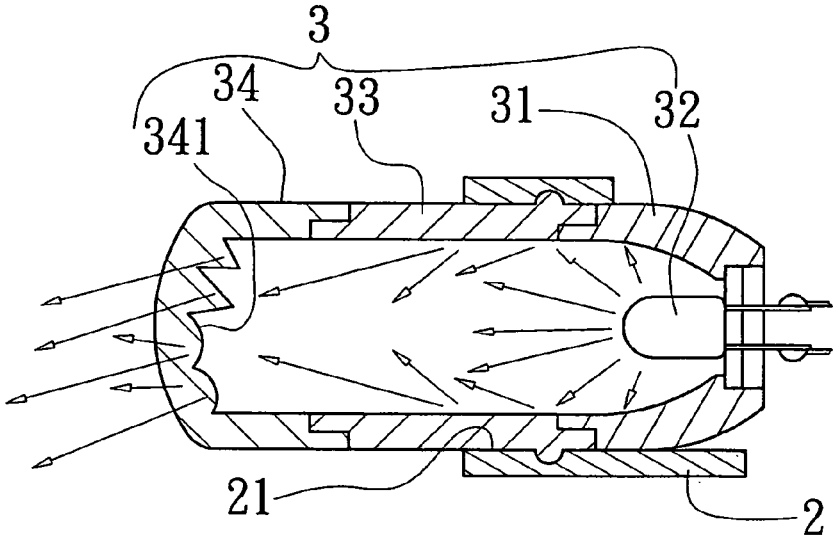
FIG. 3 is a cross-sectional view of a light source unit in the present invention.
Figure 4:
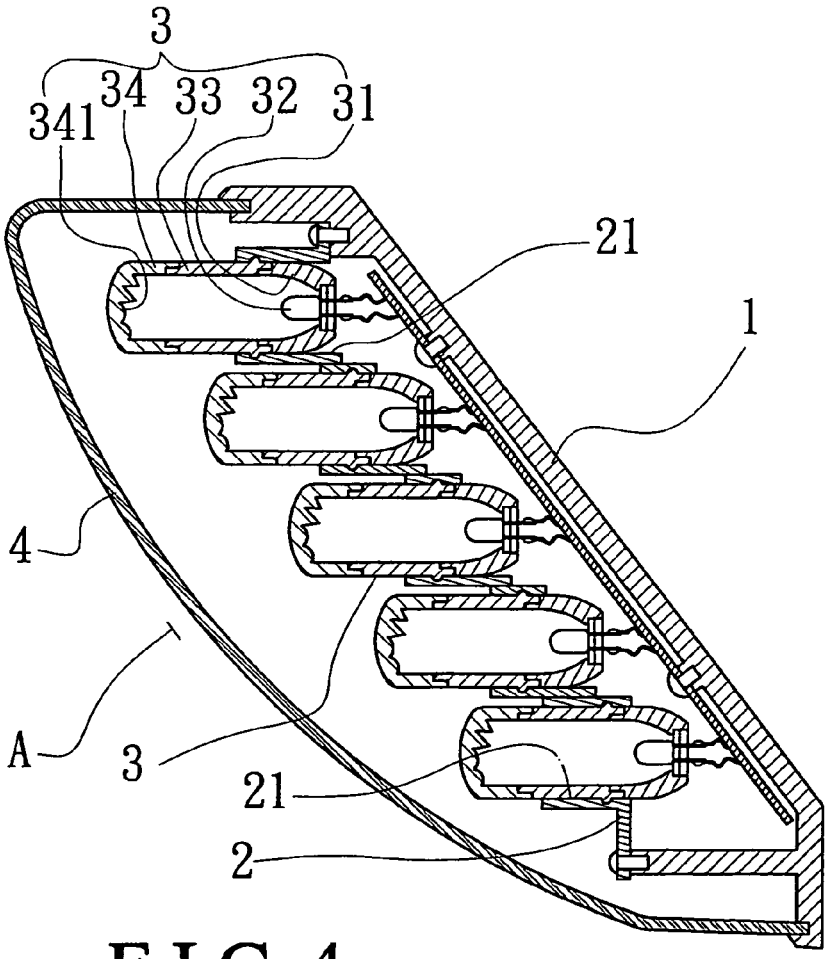
FIG. 4 is a cross-sectional view of the present vehicle light.

Referring to FIGS. 2 to 4, a vehicle light (A) of the present invention includes a shell 1, a locating member 2, several light source units 3, and a transparent cover 4.

Figure 1:
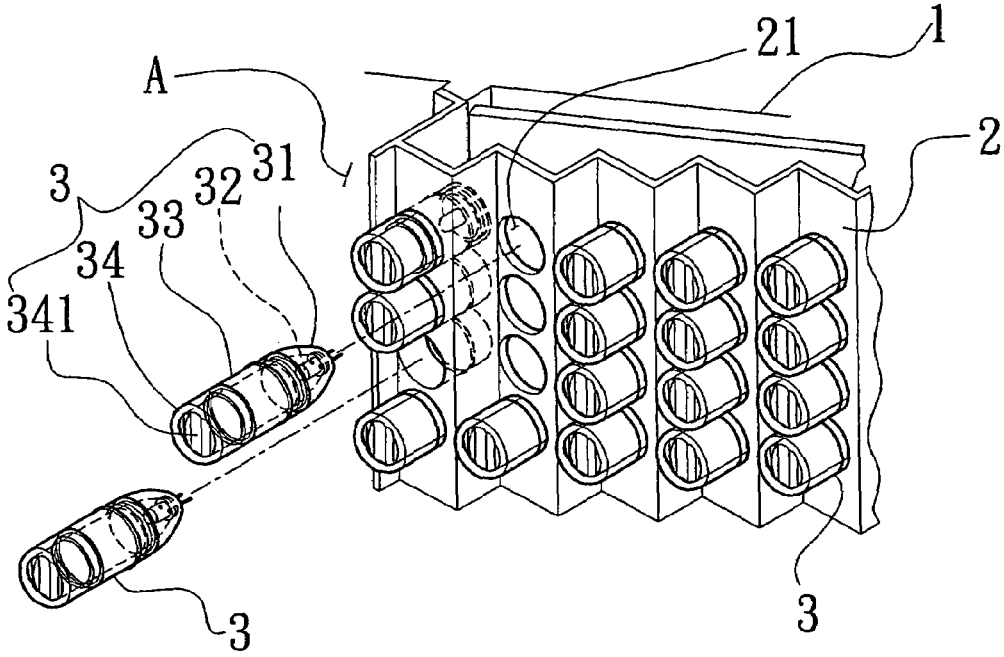
FIG. 1 is an exploded perspective view of the vehicle light according to the present invention.

The locating member 2 is disposed in the shell 1, and has several connected step portions, which are not on the same plane, as shown in FIGS. 1 and 4, and each of which has several spaced apart through holes 21 thereon.

Figure 5:
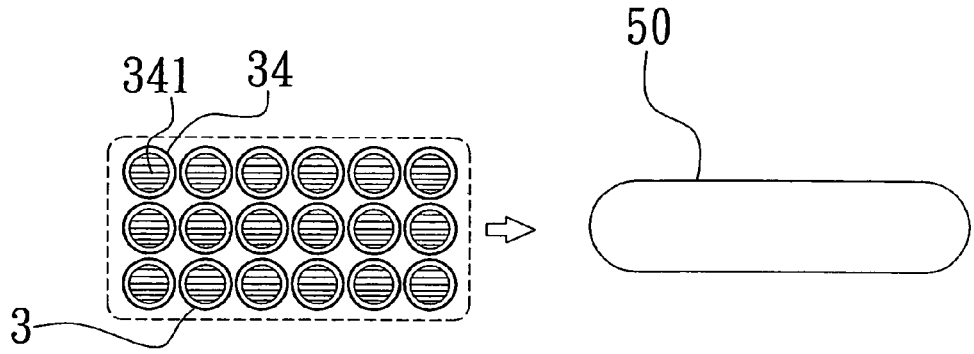
FIG. 5 is a view illustrating the way of positioning the light source units in the present invention (1)
Figure 6:
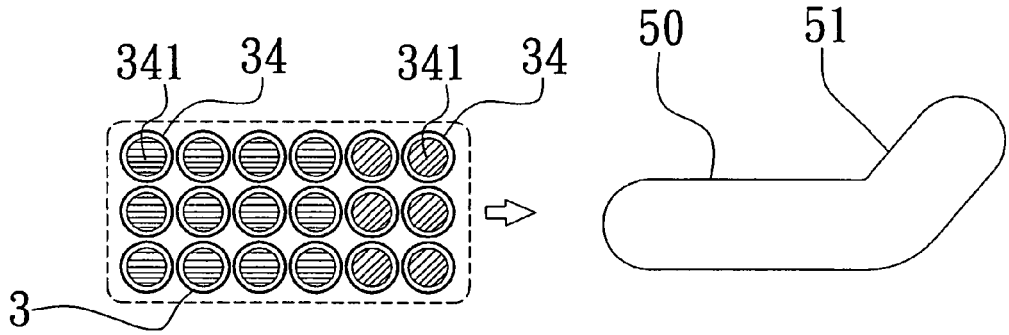
FIG. 6 is a view illustrating the way of positioning the light source units in the present invention (2)
Figure 7:
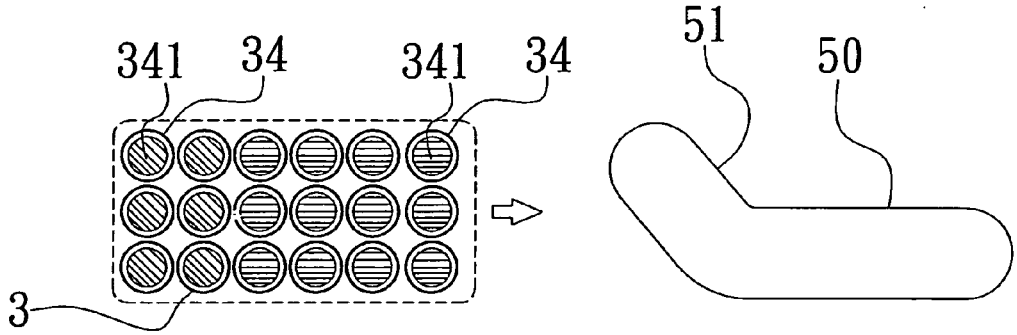
FIG. 7 is a view illustrating the way of positioning the light source units in the present invention (3)

Each of the light source units 3 includes a reflection shell part 31, an LED 32 (light emitting diode), a guiding part 33, and a transparent convex covering part 34; the LED 32 is held in the reflection shell part 31, and secured to an inward end of the reflection shell part 31 by means of welding; the guiding part 33 is joined to an outward end of the reflection shell part 31 at an inward end thereof, and the transparent convex covering part 34 is joined to an outward end of the guiding part 33; the transparent convex covering part 34 has a refraction side 341 on an inward side, which faces the LED 32, and which forms several substantially parallel lines as shown in FIGS. 5, 6, 7, etc. Thus, the reflection shell part 31, the guiding part 33, and the transparent convex covering part 34 together form a housing, in which the LED 32 is held. And, when light from the LED 32 travels through the transparent convex covering part 34, direction thereof will be made to change by the refraction side 341.

The light source units 3 are respectively fitted in the through holes 21 of the locating member 2 from the shell parts 31 thereof. And, the transparent cover 4 is connected with the shell 1 to cover the light source units 3. Because the locating member 2 is formed with the step portions, the light source units 3 are on several different planes.

Referring to FIG. 5, light from the present vehicle light will form a horizontal lighted area 50 on a plane when the light source units 3 are positioned such that all of the lines formed by the refraction elements 341 of the transparent convex covering parts 34 are horizontal. And, a sloping lighted area will be formed on a plane when the light source units 3 are powered after having been positioned such that the lines formed by the refraction elements 341 are in a sloping position. Referring to FIG. 6, because light source units 3 of a left portion of this particular vehicle light are positioned such that the lines are horizontal, and because light source units 3 of a right portion are positioned such that the lines are in a sloping position, light from this particular vehicle light will form both a left horizontal lighted area 50 and a right angled lighted area 51 on a plane; thus, an enlarged lighted area will form. Similarly, referring to FIG. 7, light from this particular vehicle light will form both a right horizontal lighted area 50 and a left angled lighted area 51 on a plane such that a larger lighted area will form.

Figure 8:
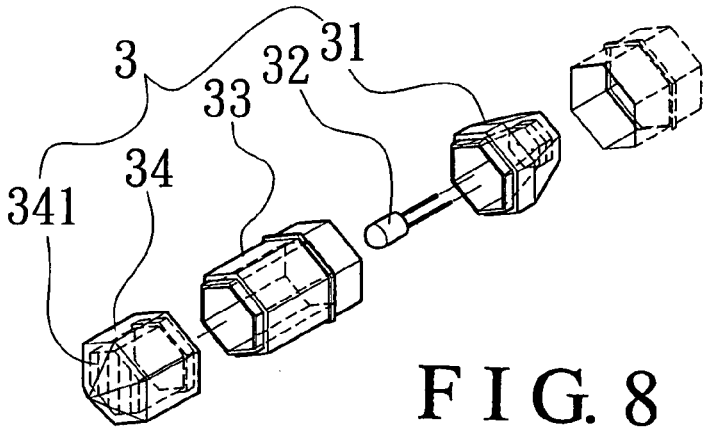
FIG. 8 is an exploded perspective view of the first embodiment of light source unit according to the present invention.
Figure 9:
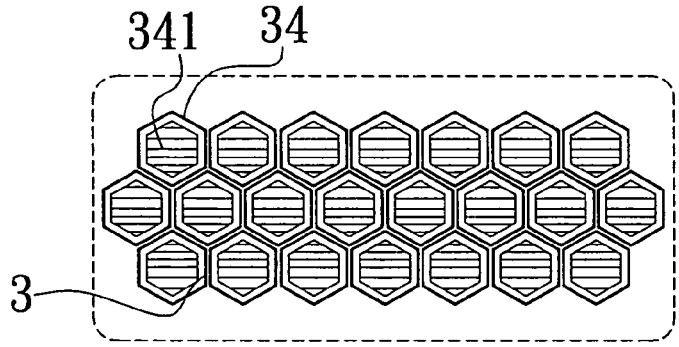
FIG. 9 is a view illustrating the way of positioning the light source units of the first embodiment (1)
Figure 10:
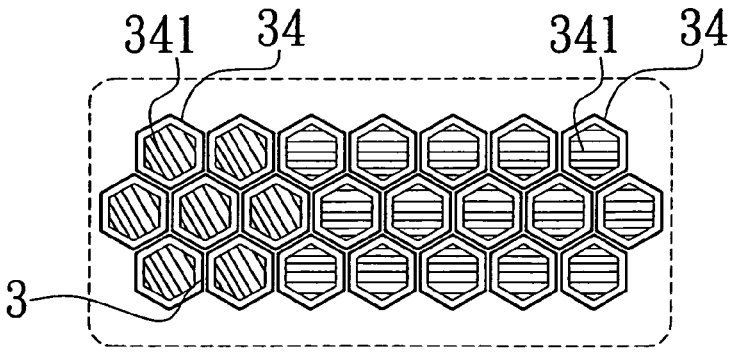
FIG. 10 is a view illustrating the way of positioning the light source units of the first embodiment (2)

The light source units 3 can be formed so as to have a round cross-section, and the through holes 21 of the locating member 2 are shaped so as to fit the light source units 3, as shown in FIGS. 1 and 2. Referring to FIG. 8, light source units 3 are formed in such a manner as to have a hexagonal cross-section instead. And, these hexagonal light source units 3 can be positioned such that all of the lines of the refraction elements 341 are horizontal (FIG. 9) or they can be positioned such that some of the lines of the refraction elements 341 are in a sloping position as shown in FIG. 10.

Figure 11:
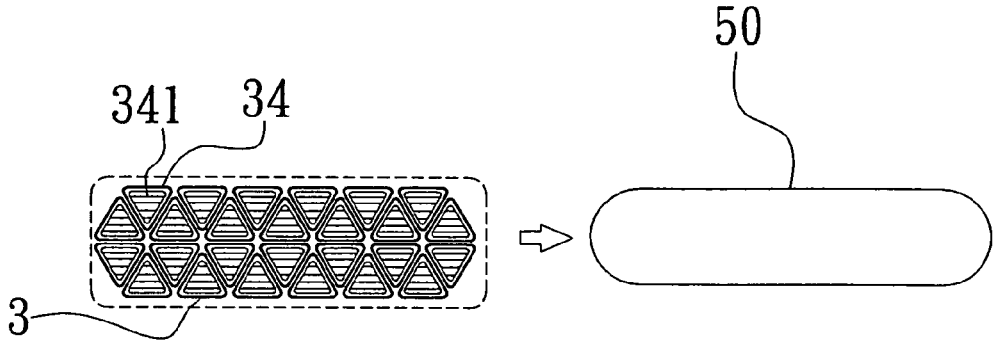
FIG. 11 is a view illustrating the way of positioning the light source units of the second embodiment (1)
Figure 12:
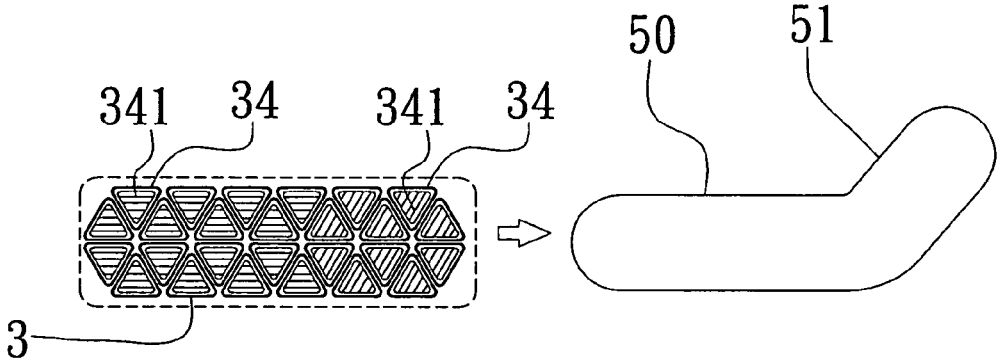
FIG. 12 is a view illustrating the way of positioning the light source units of the second embodiment (2)

Light source units 3 are formed in such a manner as to have a triangular cross-section instead, as shown in FIGS. 11 and 12; these triangular light source units 3 can be positioned such that all of the lines of the refraction elements 341 are horizontal (FIG. 11) or such that some of the lines of the refraction elements 341 are in a sloping position (FIG. 12); in the former situation, light from this vehicle light will only form a horizontal lighted area 50 on a plane (FIG. 11) while in the latter situation, light from this vehicle light will form both a left horizontal lighted area 50 and a right angled lighted area 51 on a plane (FIG. 12).

Figure 13:
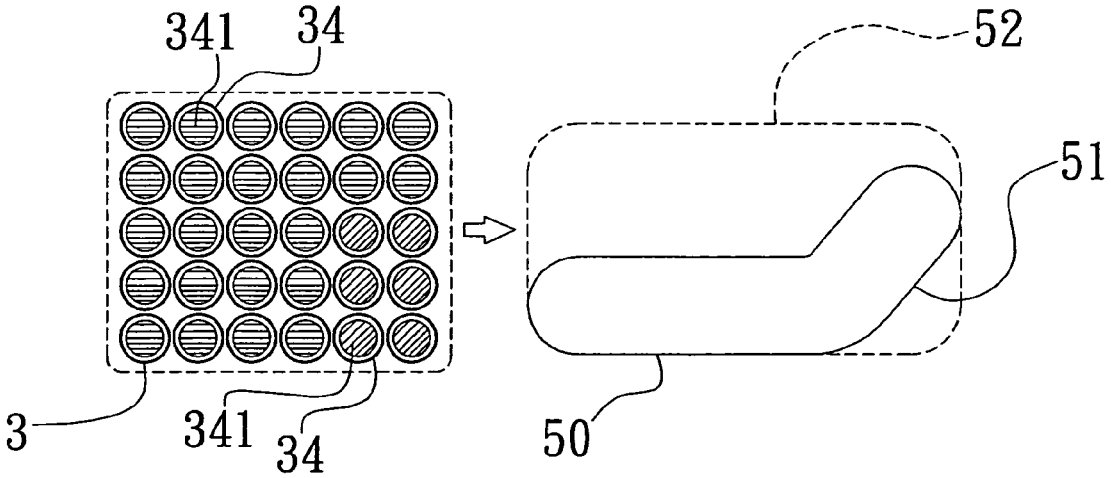
FIG. 13 is a view illustrating the way of positioning the light source units of the third embodiment.
Figure 14:
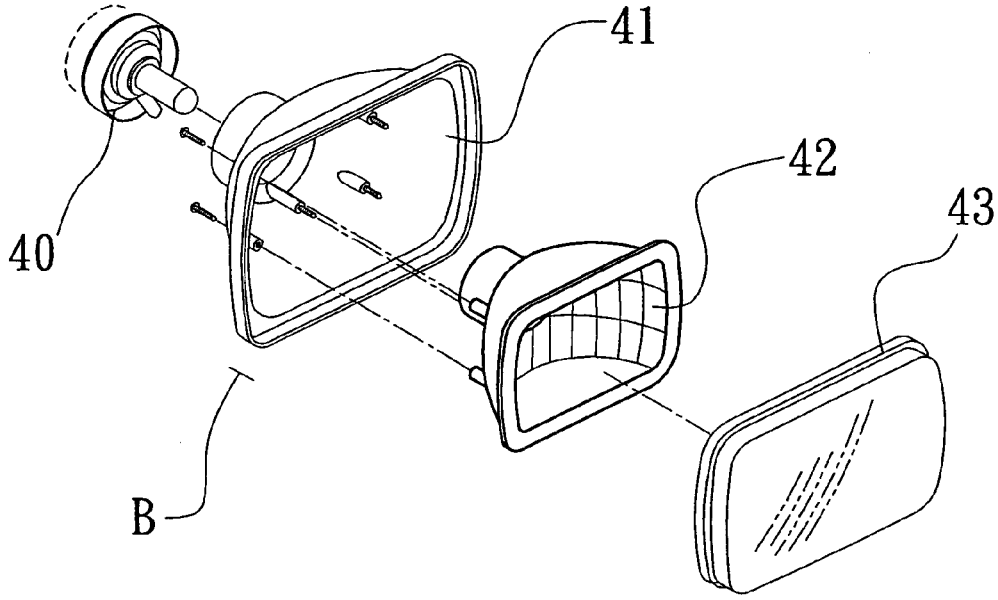
F I G. 14 (PRIOR ART)
FIG. 14 is an exploded perspective view of the conventional vehicle light.
Figure 15:
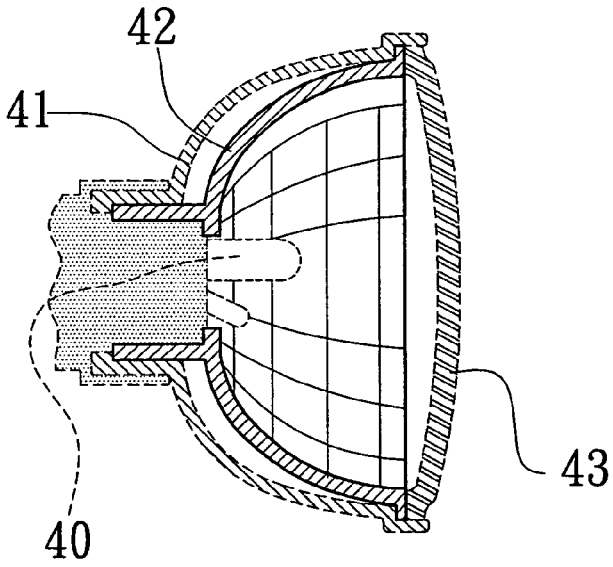
F I G. 15 (PRIOR ART)
FIG. 15 is a cross-sectional view of the conventional vehicle light.

Referring to FIG. 13, in order to be used as a headlamp, vehicle light of the present invention is equipped with three different groups of light source units 3, which are respectively on a lower left portion of the present light, a lower right portion, and an upper portion, and which are positioned such that the lines of the refraction elements 341 thereof are respectively horizontal, in a sloping position, and horizontal, and which light source units 3 of the upper portion will produce far-reaching light when being powered. Thus, when the present vehicle light is used for producing ordinary light, the light source units 3 of the lower portion thereof will be powered. And, when the present vehicle light is used for producing far-reaching light, the light source units 3 of the upper portion thereof will also be powered, and light of these upper light source units 3 will form a horizontal lighted area in addition to those lighted areas formed by the light source units 3 of the lower portion.

From the above description, it can be easily understood that because the light source units 3 are on several different planes, and because the refraction elements 341 of the light source units 3 can be in various orientations for allowing light passing through them to change direction accordingly, various vehicle lights can be provided according to the present invention, which respectively can produce a particular form of light, i.e. light that spreads out over a particular area.

What is claimed is:

1. A vehicle light, comprising a shell, the shell having a circuit board disposed thereon;

a transparent cover connected to the shell;

a locating member secured in the shell, the locating member having a plurality of step portions, each of the step portions being on a different plane; and a plurality of light source units respectively mounted to the step portions of the locating member to be on different planes, each light source unit including:

(1) a reflection shell part having a cavity therein;

(2) a light emitting diode disposed in the cavity and having a pair of leads extending therefrom, the light emitting diode being secured to an inward end of the reflection shell part with the pair of leads extending through the reflection shell part and coupled to the circuit board;

(3) an annular guiding part connected with an outward end of the reflection shell part and extending the cavity thereof; and (4) a transparent convex covering part joined to an outward end of the guiding part to enclose the cavity and the light emitting guide therein, the transparent convex covering part having a plurality of refraction elements formed on an inward side thereof facing the light emitting diode, each of the refraction elements being linearly directed, wherein light from the light emitting diode travels through the transparent convex covering part, the refraction elements making the light change direction;

whereby when the light source units are positioned such that the refraction elements of the transparent convex covering parts are in various orientations, light can be diverted into different directions by means of the refraction elements; and whereby when being activated, the vehicle light will produce light whose form depends on orientations of the refraction elements of the light source units.

* * * * *